US007636948B1

(12) United States Patent
Crye et al.

(10) Patent No.: US 7,636,948 B1
(45) Date of Patent: Dec. 29, 2009

(54) COMBAT SHIRT AND ARMOR SYSTEM

(75) Inventors: Caleb Clark Crye, Brooklyn, NY (US); Eric Owen Fehlberg, Queens, NY (US); Gregg M. Thompson, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 885 days.

(21) Appl. No.: 11/307,193

(22) Filed: Jan. 26, 2006

(51) Int. Cl.
*F41H 1/00* (2006.01)
*F41H 1/02* (2006.01)
*G21F 3/02* (2006.01)

(52) U.S. Cl. ..... 2/2.5; 2/102; 2/455

(58) Field of Classification Search ..... 2/2.5, 2/455, 456, 458, 462, 463, 464, 465, 467, 2/69, 77, 78.1, 78.3, 81, 82, 102, 103, 113–115, 2/900, DIG. 1
See application file for complete search history.

(56) References Cited

U.S. PATENT DOCUMENTS 1,363,981 A * 12/1920 Jenkins et al. ..... 2/79
1,647,656 A * 11/1927 Olsen ..... 2/115
2,079,980 A * 5/1937 Anders ..... 2/115
2,114,514 A * 4/1938 York ..... 2/93
2,281,510 A * 4/1942 Neumark ..... 2/97
2,391,535 A * 12/1945 Zelano ..... 2/93
2,610,496 A * 9/1952 Kostopoulos ..... 66/176
2,846,687 A * 8/1958 Lippman ..... 2/115
3,122,754 A * 3/1964 Wedin ..... 2/113
3,691,564 A * 9/1972 La Marre et al. ..... 2/458
3,710,395 A * 1/1973 Spano et al. ..... 2/78.1
4,191,219 A * 3/1980 Kaye ..... 139/383 R
4,195,364 A * 4/1980 Bengtsson et al. ..... 2/81
4,451,934 A * 6/1984 Gioello ..... 2/113
4,513,451 A * 4/1985 Brown ..... 2/69
4,722,099 A * 2/1988 Kratz ..... 2/79
4,870,706 A * 10/1989 Ketcham et al. ..... 2/461
4,996,723 A * 3/1991 Huhn et al. ..... 2/105
5,060,314 A * 10/1991 Lewis ..... 2/2.5
5,105,478 A * 4/1992 Pyc ..... 2/115
5,136,723 A * 8/1992 Aldridge et al. ..... 2/81
5,398,340 A * 3/1995 Kibbee ..... 2/2.5
5,408,700 A * 4/1995 Reuben et al. ..... 2/97
5,469,581 A * 11/1995 Uthoff ..... 2/69
5,495,621 A * 3/1996 Kibbee ..... 2/2.5

(Continued)

OTHER PUBLICATIONS

"Charge of the Light Brigade", by Urshula Barbour, I.D. International Design, Sep./Oct. 2003, pp. 35-42, Copyright 2003.

*Primary Examiner*—Bobby H Muromoto, Jr.
(74) *Attorney, Agent, or Firm*—Stiennon & Stiennon

(57) ABSTRACT

A protective body armor system for protection against ballistic threats has an armored element such as a vest with front and rear ballistic armor. A long-sleeved shirt is worn beneath the ballistic armor which has a wicking, lightweight, low thermal insulation torso element. Two long sleeves are connected to and extend from the torso element. The torso element is substantially overlain by portions of the armor element, while portions of the sleeve extend beyond the armored element. The shirt has a durable collar connected to the torso element and to the two sleeves. The collar extends upwardly from the armored element. The collar is less resilient than the torso element, and serves to connect the two sleeves and to restrain the garment from undesired distortion.

10 Claims, 3 Drawing Sheets

U.S. PATENT DOCUMENTS 5,515,543 A * 5/1996 Gioello ..... 2/69
5,727,256 A * 3/1998 Rudman ..... 2/115
5,845,336 A * 12/1998 Golde ..... 2/93
5,970,513 A * 10/1999 Kocher ..... 2/2.5
6,088,831 A * 7/2000 Jensen et al. ..... 2/2.5
6,164,339 A * 12/2000 Greenhalgh ..... 139/1 R
6,263,511 B1 * 7/2001 Moretti ..... 2/97
6,363,527 B1 * 4/2002 Biermann et al. ..... 2/2.5
6,418,974 B1 * 7/2002 King ..... 139/383 R
6,427,242 B1 * 8/2002 Bush et al. ..... 2/69
6,845,517 B2 * 1/2005 Aldridge et al. ..... 2/81
6,851,128 B1 * 2/2005 Parrotte ..... 2/108
6,874,332 B2 * 4/2005 Forgach ..... 62/259.3
6,892,392 B2 * 5/2005 Crye et al. ..... 2/2.5
7,017,191 B2 * 3/2006 Golde ..... 2/93
7,043,766 B1 * 5/2006 Foreman et al. ..... 2/81
7,043,767 B2 * 5/2006 Jaeger ..... 2/87
7,073,538 B2 * 7/2006 Bhatnagar et al. ..... 139/383 R
7,437,774 B2 * 10/2008 Baron et al. ..... 2/69
2002/0014300 A1 * 2/2002 Itoh ..... 156/93
2003/0070200 A1 * 4/2003 Crye et al. ..... 2/6.6
2005/0010987 A1 * 1/2005 Crye et al. ..... 2/2.5
2006/0048263 A1 * 3/2006 Walsh ..... 2/69
2008/0060113 A1 * 3/2008 Walsh ..... 2/116

* cited by examiner

COMBAT SHIRT AND ARMOR SYSTEM

BACKGROUND OF THE INVENTION

The present invention relates to ballistic protective apparel in general, and more particularly to undergarments for use with ballistic armor.

Persons exposed to projectile threats, such as police officers and soldiers, may seek a certain level of protection by wearing armored clothing. Low velocity projectiles such as handgun rounds, fragmentation rounds from a grenade or mortar, and miscellaneous shrapnel may be countered by so-called "soft armor." Soft armor is worn in the form of jackets, vests, etc. which are composed of assemblies of ballistic fabric such as those formed from DuPont Kevlar® fibers. In a more serious threat situations, where higher velocity rifle rounds must be countered, soft armor has typically been supplemented with hard armor. The hard armor is fabricated of rigid plates of ceramic, polymer, or metal. A common approach to mounting the plates to the wearer is to secure them within exterior pockets fabricated on a soft armor jacket or vest.

Conventionally, the armor jacket or vest will be worn over a durable shirt, such as a battle dress uniform blouse. The durable fabric protects the wearer from sun, dust, and minor abrasions. By wearing a conventional blouse, a soldier can remove his armor while still maintaining required uniform standards. Yet the heavy soft armor, possibly supplemented by hard armor, does not require a durable fabric beneath it, and the less breathable durable fabric can contribute to heat build-up in the wearer. Higher metabolic activities encountered under combat conditions can result in greater perspiration. It is important that this moisture be able to evaporate away from the wearer's skin, and that heat loads be dissipated.

An early combat shirt developed for the U.S. Army employs a lightweight wicking fabric in the torso, while the sleeves of the garment, which may not be covered by the armor, are composed of a durable, less open, fabric. The torso fabric may be similar to that used in UNDER ARMOUR® undershirts marketed by Under Armour, Inc. of Baltimore, Md. By forming the combat shirt from materials with differing properties, the wearer's arms are protected, while heat dispersion is facilitated. However, the wicking material is also more elastic or stretchable than the durable fabric, with the result that the shirt tends to lose its shape, with the durable sleeves pulling down the resilient torso material at the shoulders.

What is needed is a combat shirt having desirable protective and wicking abilities, yet which at the same time satisfactorily retains its shape on the wearer.

SUMMARY OF THE INVENTION

A protective body armor system for protection against ballistic threats of this invention has an armored element such as a vest with front and rear ballistic armor. A long-sleeved shirt is worn beneath the ballistic armor which has a wicking, lightweight, low thermal insulation torso element. Two long sleeves are connected to and extend from the torso element. The shirt has a durable collar connected to the torso element and to the two sleeves. The collar extends upwardly from the armored element. The collar is less stretchy than the torso element, and serves to connect the two sleeves and to restrain the garment from undesired distortion. The torso element is substantially overlain by portions of the armored element, while the collar and portions of the sleeve extend beyond the armored element. The collar and sleeves are formed of a more durable material than the torso element.

It is an object of this invention to provide a body armor system having a base layer shirt which has different wicking and durability properties under armored and unarmored regions, and which resists undesired distortion.

Further objects, features and advantages of the invention will be apparent from the following detailed description when taken in conjunction with the accompanying drawings.

DESCRIPTION OF THE PREFERRED EMBODIMENTS

Figure 1:
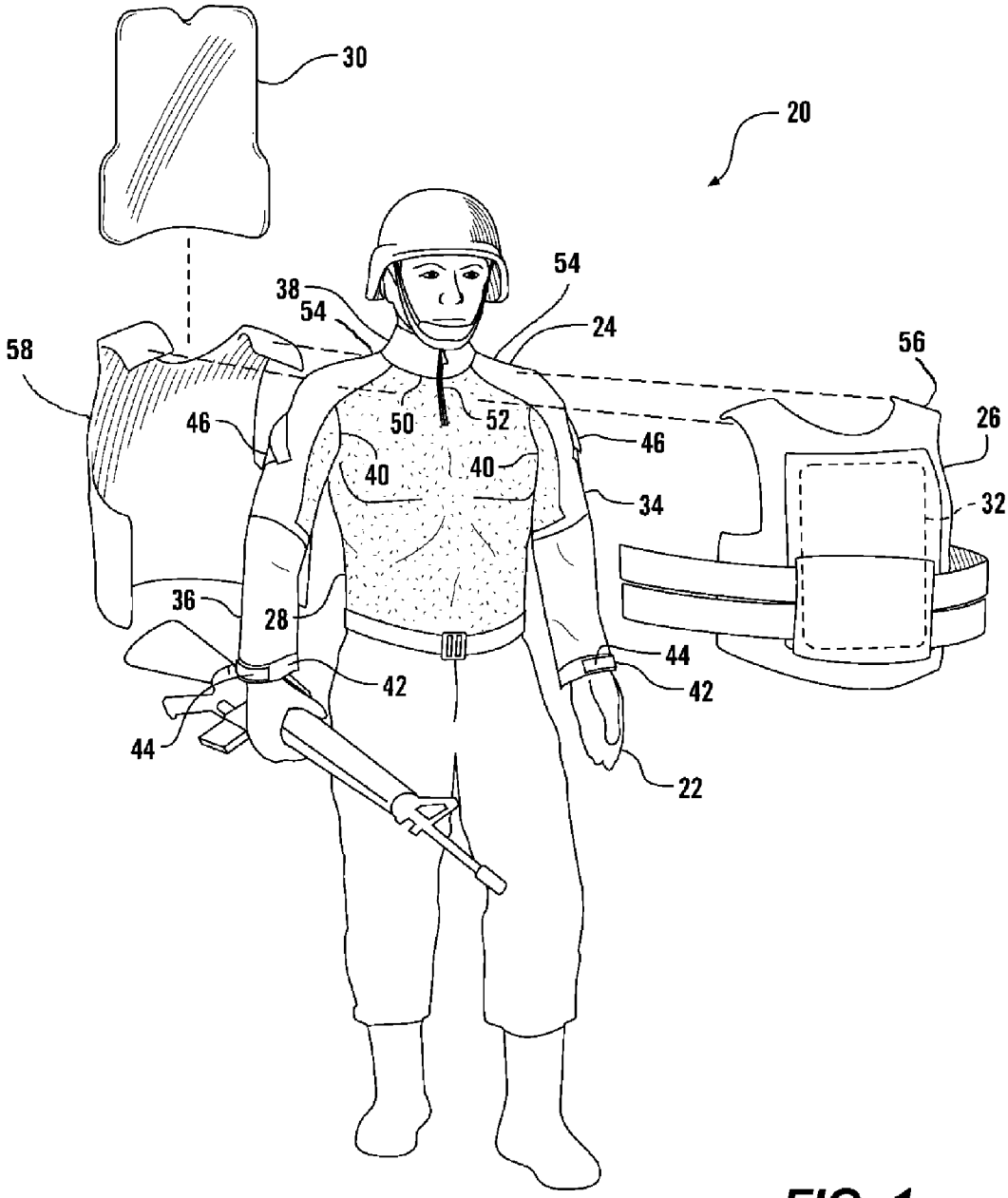
FIG. 1 is an exploded perspective view of the combat shirt and armor system of this invention shown in relation to a soldier.
Figure 2:
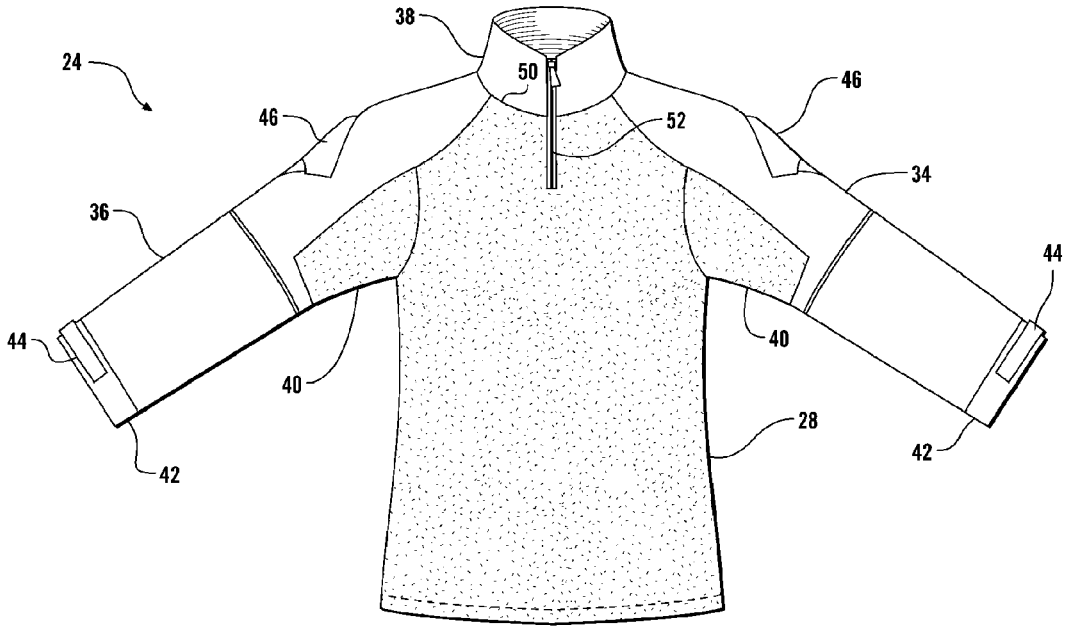
FIG. 2 is a front elevational view of the combat shirt of FIG. 1
Figure 3:
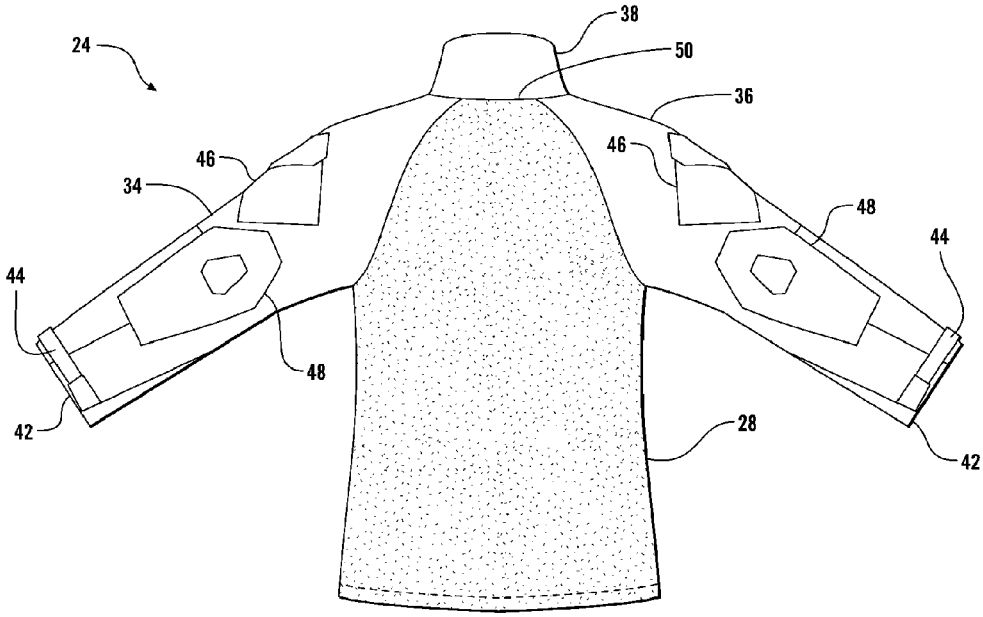
FIG. 3 is a rear elevational view of the combat shirt of FIG. 2.

Referring more particularly to FIGS. 1-3, wherein like numbers refer to similar parts, a body armor system 20 of this invention is shown in relation to a wearer 22 in FIG. 1. The wearer 22 will typically be a soldier or police officer performing duties which present a risk of encountering gunfire. Such duties not infrequently call for high levels of exertion while carrying equipment. The armor system 20 is comprised of a shirt 24 worn with an armored element 26. The armored element 26 may be a ballistic vest such as is disclosed in our U.S. Pat. No. 6,892,392, the disclosure of which is incorporated by reference herein, or it may be any conventional ballistic vest, for example the U.S. Military Interceptor Multi-Threat Body Armor System, or its predecessor the Personnel Armor System for Ground Troops (PASGT) vest. The vest may have soft armor 30 or plate armor 32 inserts. The vest has a front section 56 with the armor 32, and a rear section 58 with the armor 30.

The shirt 24 is fabricated of different fabrics to provide different functions at different locations. As shown in FIG. 1, the shirt 24 is worn directly against the body of the wearer 22 without any underlying garment. The shirt 24 has a torso element 28. A left sleeve 34 and a right sleeve 36 are sewn to the torso element 28. The sleeves are connected to each other by an upwardly extending collar 38. The collar 38 may be formed of a single strip of fabric, and serves as a connecting strip between the sleeves, which prevents distortion of the torso element 28 causing the sleeves to be excessively displaced from one another. The sleeves 34, 36 may be raglan sleeves which extend in one piece from the arm to the collar 38, to avoid the need to place a seam on the shoulder of the wearer. Both sleeves 34, 36 have lateral portions 54 extending toward the collar 28 which do not conform to the arms.

Under arm panels 40 are preferably provided which extend from the torso element 28 to each sleeve 34, 36, beneath the sleeves. The under arm panels 40 are preferably fabricated of the same material as the torso element 28. The sleeves and collar are fabricated of a durable material, as they will be exposed to the environment, and can encounter dirt, impact, and abrasion.

The durability of a material may be measured, for example, by its performance in the Modified Wyzenbeek abrasion test, or by ASTM D 4157 Standard Test Method for Abrasion Resistance of Textile Fabrics (Oscillatory Cylinder Method), or by any abrasion test measured in cycles. A higher number indicates that the fabric survived a greater number of abrasion cycles, and is hence of greater durability or abrasion resistance. The sleeves and collar are fabricated of a material which is substantially more durable/abrasion resistant than the material of the torso element, preferably having a modified Wyzenbeek abrasion test score which is at least 50 percent greater. The collar and sleeves may be formed of material which is of greater weight than the material of the torso element. Weight is a conventional measure of fabric properties, and is usually presented in terms of ounces of weight per square yard of material. Typically, the sleeves and collar will be fabricated of material having a weight of from about 6 to about 8 oz/yard$^2$, while the torso material will have a weight of about 3 to 5 oz/yard$^2$, although with appropriately durable lightweight material, and heavier wicking material, in some situations the weights may be the same, or the torso element material may have a greater weight than the sleeve or collar material. The material of which the torso element is fabricated is a stretchable fabric, for example having a stretch of 60 to 100 percent, while the material of which the collar is fabricated is a very low stretch fabric, preferably having approximately no stretch. A level of stretch may be defined as the amount a given sample of material will stretch in response to a given applied tension in a particular direction.

The torso element material may be cotton, wool, polyester, nylon, or a blend thereof. A preferred embodiment is a polyester, Lycra® brand synthetic polyurethane-based elastane textile blend, which is stretchy and form fitting. A cotton material may be used where flame retarding properties are required. Cotton will usually not wick as well, but also resists melting better for environments likely to encounter flame and melting temperatures.

The torso element 28 is preferably formed of a knit material, for example microfiber polyester. The material may be a tubular knit which is a continuous tube of material, or a warp knit which results in seams running up and down the sides of the torso. The torso element material has a low clo value, and also serves to wick away perspiration from the wearer's body. However, this knit material is also more resilient, and is sized to cling or conform to the wearer's torso. As a result, the torso element is readily deformed and distorted. While the strands in woven fabrics extend straight horizontally and vertically, knit threads follow a loopy path as they extend in rows, with the result that a knit fabric piece will be stretchy in all directions.

The stretchy torso element material's stretchiness permits it to cling tightly or very tightly to the wearer. This clinging helps to keep the torso element material from bunching up beneath the armor and forming folds under the armor that can be uncomfortable.

The sleeves 34, 36 are terminated with cuffs 42 which may be tightened with overlapping strips 44 provided with hook and loop fastener such as VELCRO® material of Velcro Industries B.V. Ltd Liab. Co., of the Netherlands. As best shown in FIG. 3, the sleeves may have closable pockets 46 above the elbows. Each sleeve may also have a pad pocket 48 positioned to receive an elbow pad or elbow protector, not shown.

The collar 38 extends upwardly from a neck hole 50 defined by the two sleeves and the torso element. To permit the wearer's head to pass through the collar 38, the collar is provided with a closure 52 such as a zipper closure. The zipper extends from the torso element 28 through the collar 38 at the front of the shirt 24. When the closure 52 is unzipped, the shirt 24 may be passed over the wearer's head.

The thermal insulation value of clothing is measured in clo. 1 clo=1.55 m$^{2}$° C./W. The clo unit relates to the quantity of clothing required on a subject at rest at room temperature to be comfortable. A higher clo value provides higher insulation.

The sleeves 34, 36 and the collar 38 are fabricated from a material which is more dimensionally stable than the torso element material, i.e., which is less resilient, and less given to distortion when subjected to tension. This material is preferably a woven fabric, woven of a cotton polyester blend fiber. The collar and sleeve material is more durable than the torso element material, and also has a higher clo value.

Although the collar, by extending upwardly from the torso element 28, serves to protect the wearer's neck, the function of connecting the sleeves and maintaining the shape of the garment may be formed by a connecting strip between the sleeves which lies flat as it encircles the neck hole 50, and which does not protrude upwardly from the garment shoulders.

The shirt 24 preferably has two types of elements, the torso element which is an element which conforms to the body of the wearer, and the sleeves and collar which do not conform to the body of the wearer. By "conforming" is meant an element having sufficient elasticity to be placed over a body portion which is of greater circumferential size than the element so that substantially all the material making up the element is brought into compressive intimate contact by reason of the elasticity of the element. By "nonconforming" is meant an element having in itself not a significant cause of compressive intimate contact by reason of its lack of significant elasticity.

It is understood that the invention is not limited to the particular construction and arrangement of parts herein illustrated and described, but embraces all such modified forms thereof as come within the scope of the following claims.

What is claimed is:

1. A body armor system comprising:

an armored element having a front section and a rearwardly spaced rear section connected to the front section, portions of the armored element comprising ballistic armor; and a shirt having portions disposed beneath the armored element, the shirt having two sleeves which are connected to and which extend from a torso element, the torso element being substantially overlain by portions of the armored element, and portions of the sleeves extending beyond the armored element so as not to be overlain thereby, and the shirt having a collar which is connected to the torso element and to the two sleeves, the collar extending upwardly from the armored element, wherein the torso element is composed of a wicking material of a first level of stretch, and the two sleeves and the collar being composed of a durable material of a level of stretch which is less than the first level of stretch.

2. The shirt of claim 1 wherein the collar and the sleeves are formed of a woven material, and the torso element is formed of a knit material.

3. The shirt of claim 1 wherein the collar and the sleeves have a higher clo value than the torso element.

4. The shirt of claim 1 further comprising a closure which extends upwardly from the torso element across the collar.

5. A body armor system comprising:

an armored element having a front section and a rearwardly spaced rear section connected to the front section, portions of the armored element comprising ballistic armor; and a shirt having portions disposed beneath the armored element, the shirt having two sleeves which are connected to and which extend from a torso element, the torso element being substantially overlain by portions of the armored element, and portions of the sleeves extending beyond the armored element so as not to be overlain thereby, and the shirt having a collar which is connected to the torso element and to the two sleeves, the collar extending upwardly from the armored element, wherein the torso element is composed of a knit wicking material and the two sleeves and the collar being composed of a woven material, the collar being connected between the two sleeves to restrain excessive downward distortion of the sleeves.

6. The shirt of claim 5 further comprising a closure which extends upwardly from the torso element across the collar.

7. The shirt of claim 5 wherein the collar is connected to the sleeves by connecting strips composed of a woven material.

8. The shirt of claim 7 wherein the sleeves, the collar and the connecting strips are non-conforming and the torso element is conforming.

9. The shirt of claim 5 wherein each sleeve has a portion which extends to the collar.

10. The shirt of claim 7 wherein the sleeves and the collar are non-conforming and the torso element is conforming.

* * * * *

UNITED STATES PATENT AND TRADEMARK OFFICE

CERTIFICATE OF CORRECTION

PATENT NO. : 7,636,948 B1
APPLICATION NO. : 11/307193
DATED : December 29, 2009
INVENTOR(S) : Crye et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1009 days.

Signed and Sealed this

Ninth Day of November, 2010

David J. Kappos

David J. Kappos
*Director of the United States Patent and Trademark Office*